US011579550B2

(12) United States Patent
Nakamoto et al.

(10) Patent No.: US 11,579,550 B2
(45) Date of Patent: Feb. 14, 2023

(54) FIXING DEVICE INCLUDING HEAT EQUALIZING MEMBER AND IMAGE FORMING APPARATUS

(71) Applicant: CANON KABUSHIKI KAISHA, Tokyo (JP)

(72) Inventors: Atsushi Nakamoto, Tokyo (JP); Tsuguhiro Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/471,008

(22) Filed: Sep. 9, 2021

(65) Prior Publication Data

US 2022/0100128 A1 Mar. 31, 2022

(30) Foreign Application Priority Data

Sep. 28, 2020 (JP) ..... JP2020-162244

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01); *G03G 15/2042* (2013.01); *G03G 2215/2035* (2013.01)

(58) Field of Classification Search
CPC ..... G03G 15/2017; G03G 15/2039; G03G 15/2042; G03G 15/2053; G03G 2215/2025; G03G 2215/2035
USPC ..... 399/329, 330, 334; 219/216
See application file for complete search history.

(56) References Cited

U.S. PATENT DOCUMENTS

| | | | | |
|---|---|---|---|---|
| 10,067,448 | B2 | 9/2018 | Nishida et al. | G03G 15/2028 |
| 10,067,449 | B2 | 9/2018 | Matsuda et al. | G03G 15/2053 |
| 10,444,682 | B2 | 10/2019 | Nakamoto et al. | G03G 15/657 |
| 10,838,336 | B2 | 11/2020 | Yoshida et al. | G03G 15/5004 |
| 10,921,737 | B2 | 2/2021 | Sato et al. | G03G 15/2039 |
| 11,003,118 | B2 | 5/2021 | Yoshida et al. | G03G 15/2042 |
| 11,073,778 | B2 | 7/2021 | Doda et al. | G03G 15/2053 |
| 11,092,916 | B2 | 8/2021 | Yoshida et al. | G03G 15/2039 |
| 11,156,944 | B2 | 10/2021 | Takeda et al. | G03G 15/2039 |
| 2014/0093290 | A1* | 4/2014 | Soeda | G03G 15/2053 399/329 |

(Continued)

FOREIGN PATENT DOCUMENTS

| | | |
|---|---|---|
| JP | H11-260533 | 9/1999 |
| JP | 2015-102718 | 6/2015 |

(Continued)

*Primary Examiner* — Robert B Beatty
(74) *Attorney, Agent, or Firm* — Venable LLP

(57) ABSTRACT

A fixing device includes a heater, a first rotatable member, a second rotatable member, and a heat equalizing member. In a case that a region including a center of the heat equalizing member with respect to a longitudinal direction is a first region, a region closer to an end of the heat equalizing member than the first region is with respect to the longitudinal direction is a second region, and a region closer to the end of the heat equalizing member than the second region is with respect to the longitudinal direction is a third region. When the heat equalizing member has thermal capacities per unit length in the first region, the second region, and the third region are Cα, Cβ and Cγ, respectively, Cα, Cβ and Cγ satisfy the following relationship:

$C\alpha > C\beta$, and $C\gamma > C\beta$.

15 Claims, 11 Drawing Sheets

(56) References Cited

U.S. PATENT DOCUMENTS

| | | | | |
|---|---|---|---|---|
| 2015/0234330 | A1* | 8/2015 | Nakada | G03G 15/2039 399/329 |
| 2016/0098001 | A1* | 4/2016 | Ogawa | G03G 15/2053 399/338 |
| 2017/0010571 | A1 | 1/2017 | Matsuda et al. | G03G 2215/2035 |
| 2018/0284669 | A1* | 10/2018 | Fujimoto | G03G 15/2053 |
| 2020/0401068 | A1* | 12/2020 | Matsuda | G03G 15/2017 |
| 2021/0072684 | A1 | 3/2021 | Doda et al. | G03G 15/2053 |
| 2021/0132528 | A1 | 5/2021 | Sato et al. | G03G 15/2039 |
| 2021/0165351 | A1 | 6/2021 | Doda et al. | G03G 15/2064 |
| 2021/0333732 | A1 | 10/2021 | Yoshida et al. | G03G 15/80 |
| 2021/0333733 | A1 | 10/2021 | Doda et al. | G03G 2215/2035 |

FOREIGN PATENT DOCUMENTS

| | | |
|---|---|---|
| JP | 2017-207535 | 11/2017 |
| JP | 2020-038403 | 3/2020 |
| JP | 2020-098352 | 6/2020 |

* cited by examiner (a)

(b)

(c)

FIXING DEVICE INCLUDING HEAT EQUALIZING MEMBER AND IMAGE FORMING APPARATUS

FIELD OF THE INVENTION AND RELATED ART

The present invention relates to a fixing device used in an image forming apparatus for forming an image on a recording material and relates to the image forming apparatus.

In the image forming apparatus of an electrophotographic type, a toner image transferred on the recording material is fixed on the recording material by being heated and pressed by the fixing device. As a fixing type, a film fixing type using a heat generating member and a cylindrical film has been widely used. Further, as a means for suppressing an excessive temperature rise of the fixing device in a non-sheet-passing region, in which the recording material does not pass, when recording materials with a width narrower than a width of a maximum size of a feedable recording material are continuously passed (hereinafter, this temperature rise is referred to as a non-sheet-passing portion temperature rise), the following constitution has been known. That is, a constitution in which between the heat generating member and a holding member for holding the heat generating member, a heat equalizing member larger in thermal conductivity than the heat generating member is provided and thus heat of the heating generating member is taken has been known (for example, Japanese Laid-Open Patent Application Hei 11-260533).

In recent years, with speed-up of the image forming apparatus, it has been required that a time from an instruction to start printing by a user to discharge of a first recording material (first print out time, hereinafter referred to as a FPOT) is shortened and thus a user waiting time is reduced. The above-described constitution in which the heat equalizing member larger in thermal conductivity than the heat generating member is disposed between the heat generating member and the holding member for holding the heat generating member is effective in suppression of the non-sheet-passing portion temperature rise. However, heat of a heater which is the heat generating member is taken by the heat equalizing member, whereby a time until a temperature of a fixing film increases up to a temperature suitable for image formation becomes long and thus is problematic for shortening the FPOT.

SUMMARY OF THE INVENTION

According to an aspect of the present invention, there is provided a fixing device for fixing a toner image on a recording material, comprising: a heater including a heat generating element; a first rotatable member configured to be heated by the heat generating element; a second rotatable member configured to form a nip in cooperation with the first rotatable member; and a heat equalizing member provided adjacent to a surface of the heater opposite from a surface of the heater opposing the first rotatable member and configured to equalize a temperature of the heater, wherein in a case that a region including a center of the heat equalizing member with respect to a longitudinal direction is a first region, a region closer to an end of the heat equalizing member than the first region is with respect to the longitudinal direction is a second region, and a region closer to the end of the heat equalizing member than the second region is with respect to the longitudinal direction is a third region, when the heat equalizing member has thermal capacities per unit length in the first region, the second region, and the third region are $C\alpha$, $C\beta$ and $C\gamma$, respectively, $C\alpha$, $C\beta$ and $C\gamma$ satisfy the following relationship:

$$C\alpha > C\beta, \text{ and } C\gamma > C\beta.$$

Further features of the present invention will become apparent from the following description of exemplary embodiments with reference to the attached drawings.

Figure 3:
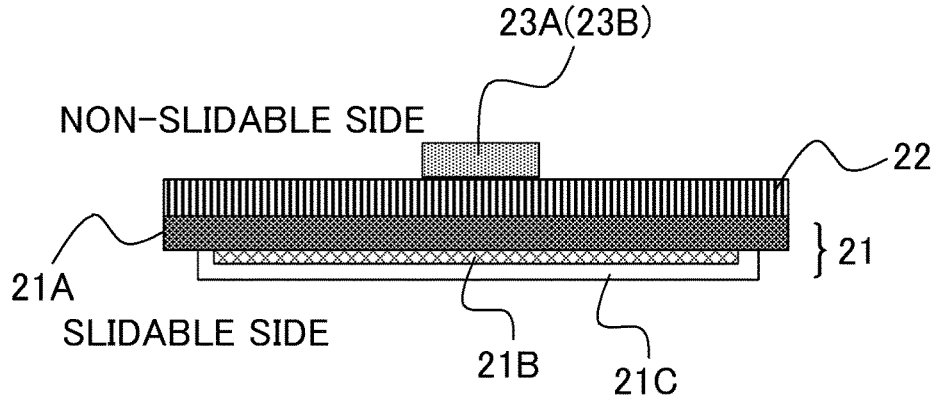
Figure 3:
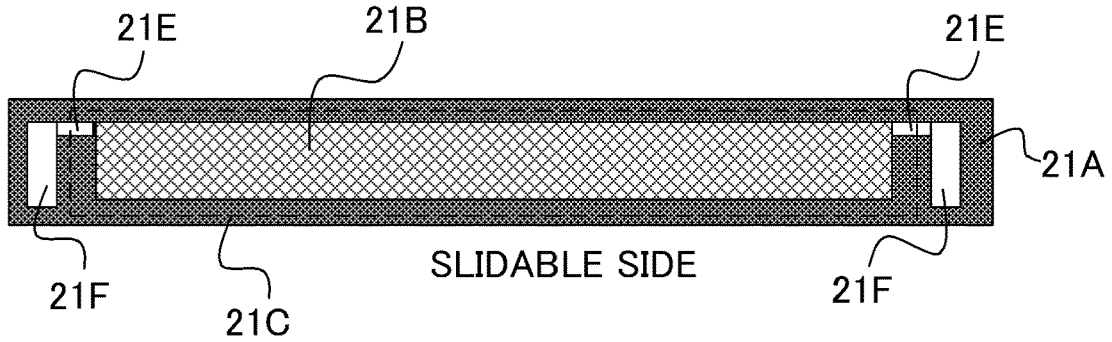
Figure 3:
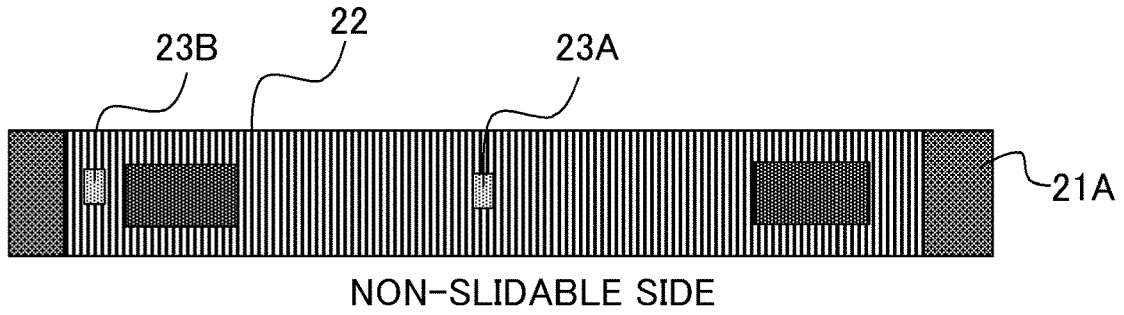

Parts (a) to (c) of FIG. 3 are schematic views showing a structure of a heater in the embodiment.

Figure 4:
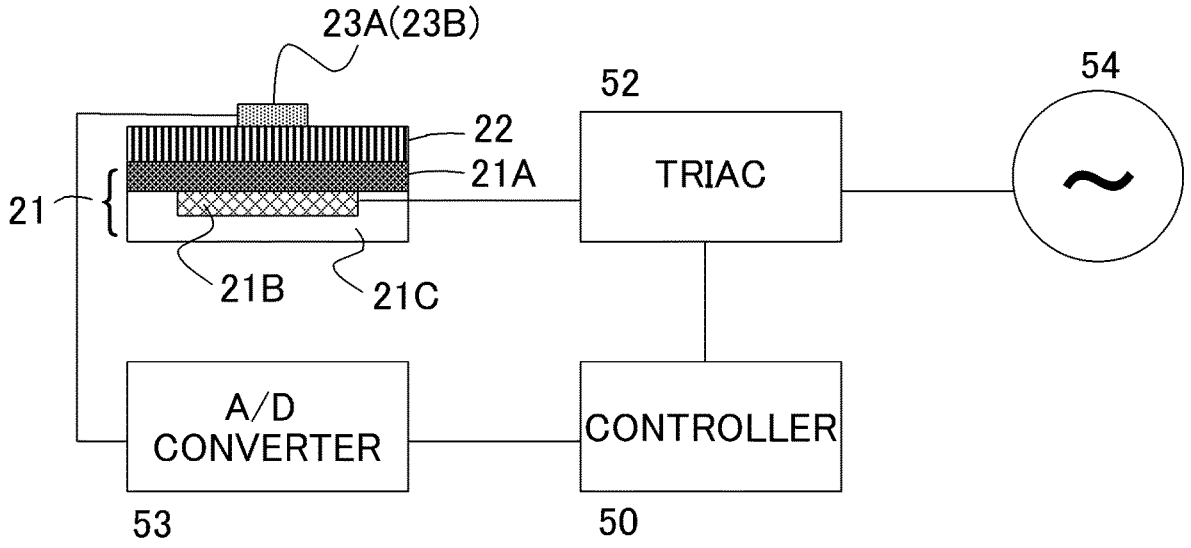

FIG. 4 is a block diagram for illustrating control of the heater in the embodiment.

Figure 5:
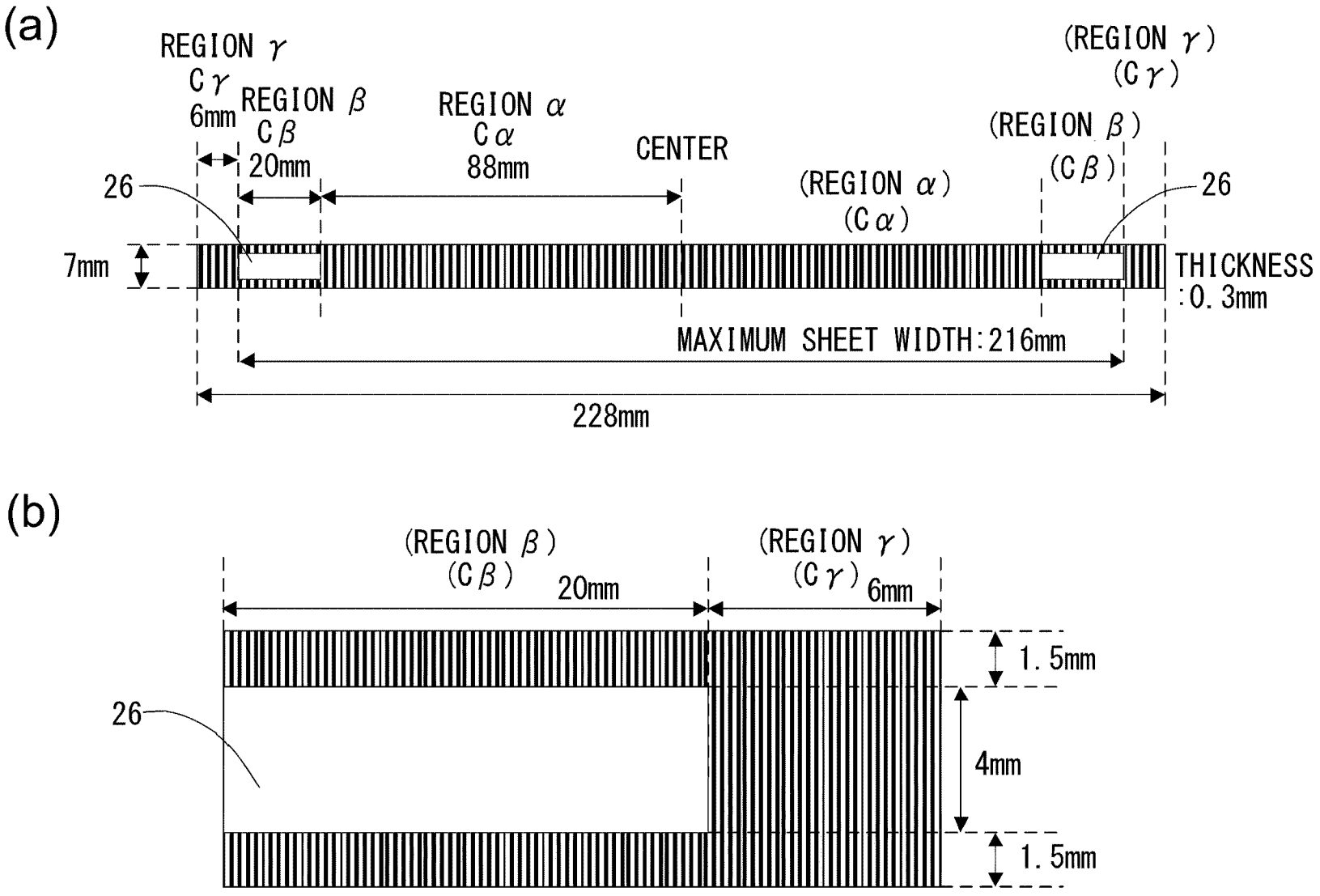

Parts (a) and (b) of FIG. 5 are schematic views showing a structure of a heat equalizing member in the embodiment.

Figure 6:
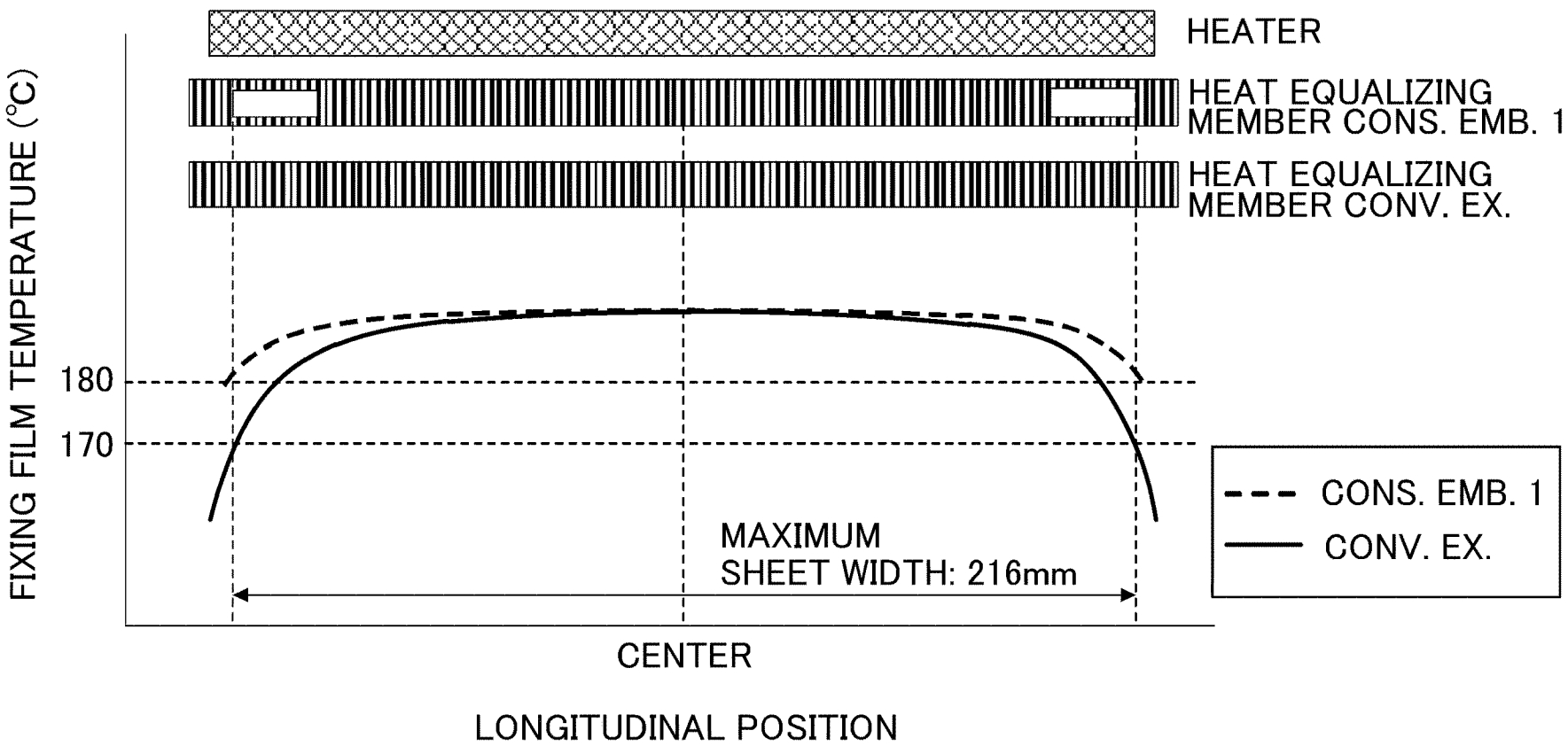

FIG. 6 is a graph showing a temperature profile of a fixing film in the embodiment.

Figure 7:
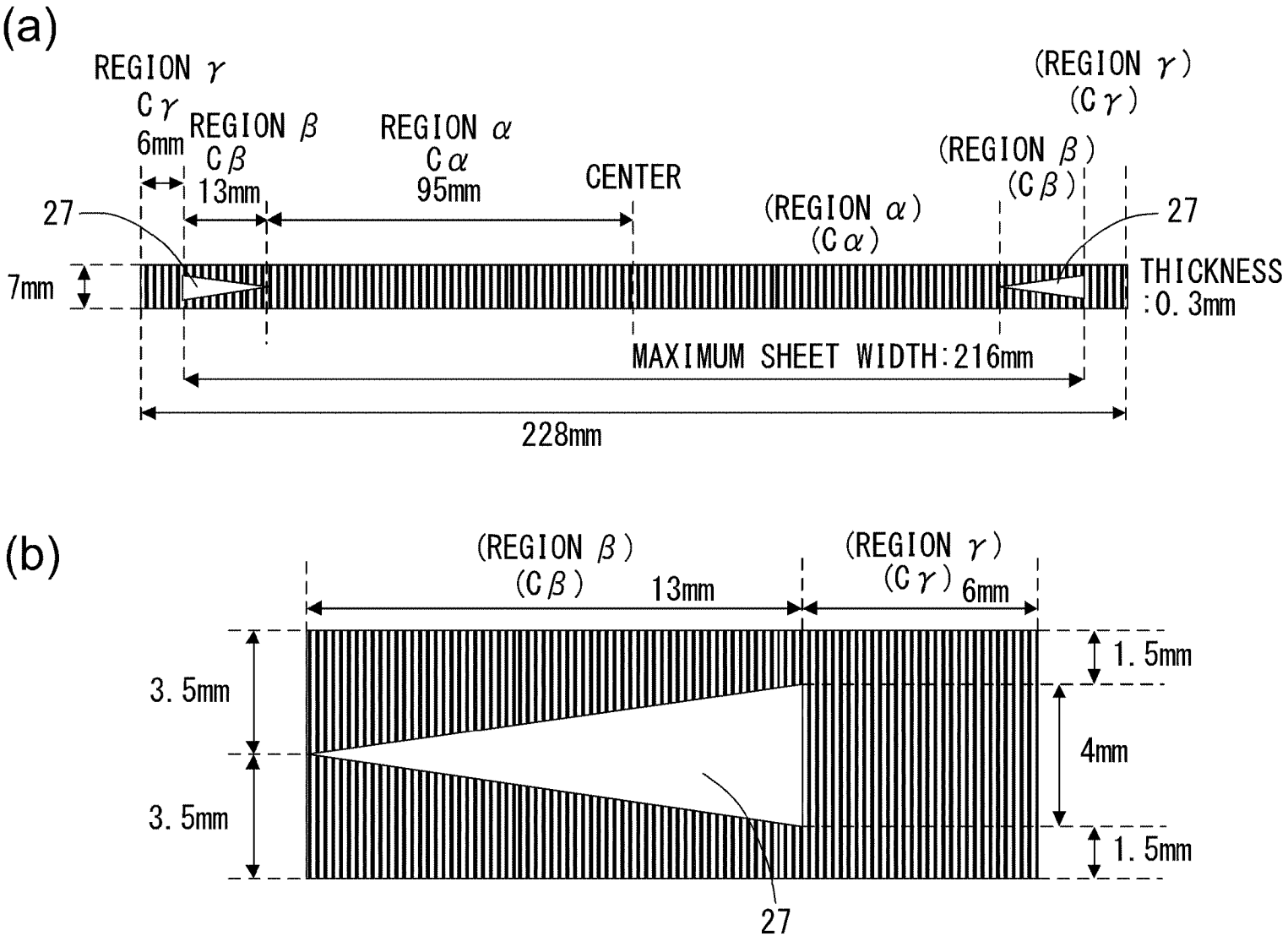

Parts (a) and (b) of FIG. 7 are schematic views showing a structure of a heat equalizing member in the embodiment.

Figure 8:
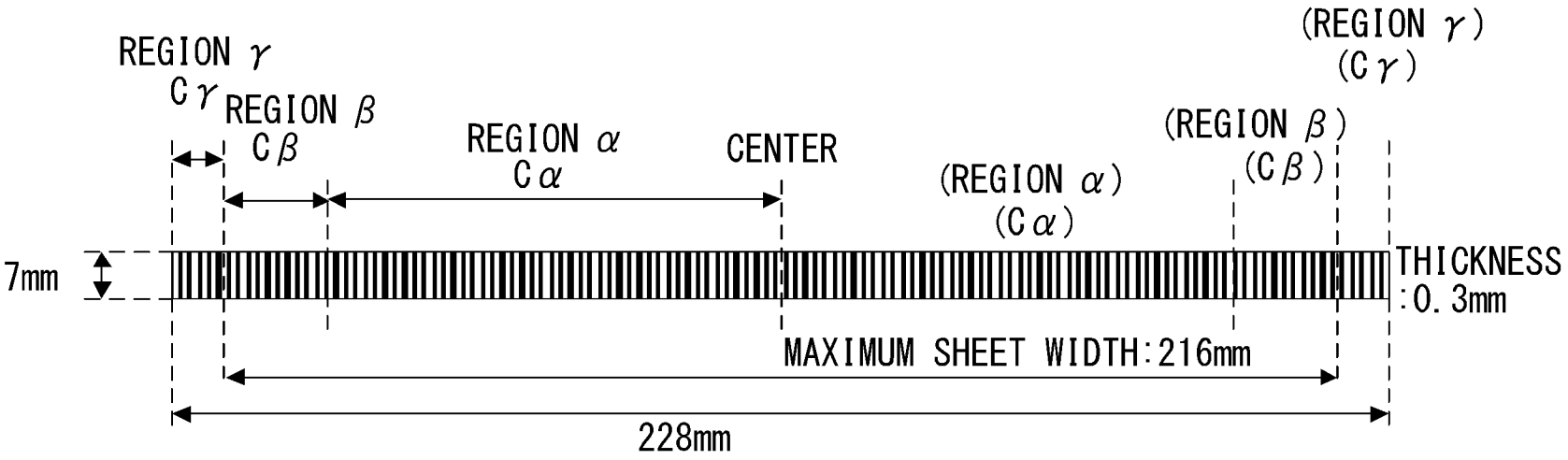

FIG. 8 is a schematic view showing a structure of a heat equalizing member in a conventional example.

Figure 9:
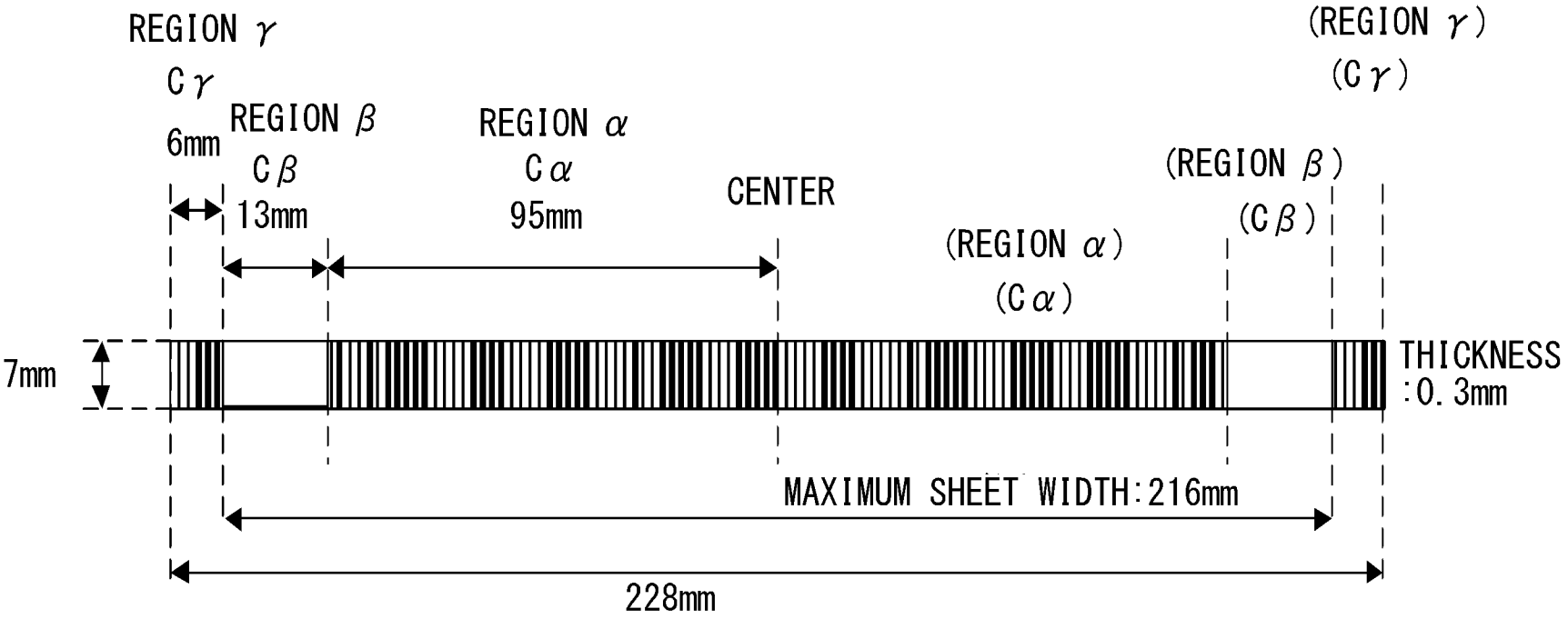

FIG. 9 is a schematic view showing a structure of a heat equalizing member in a comparison example.

Figure 10:
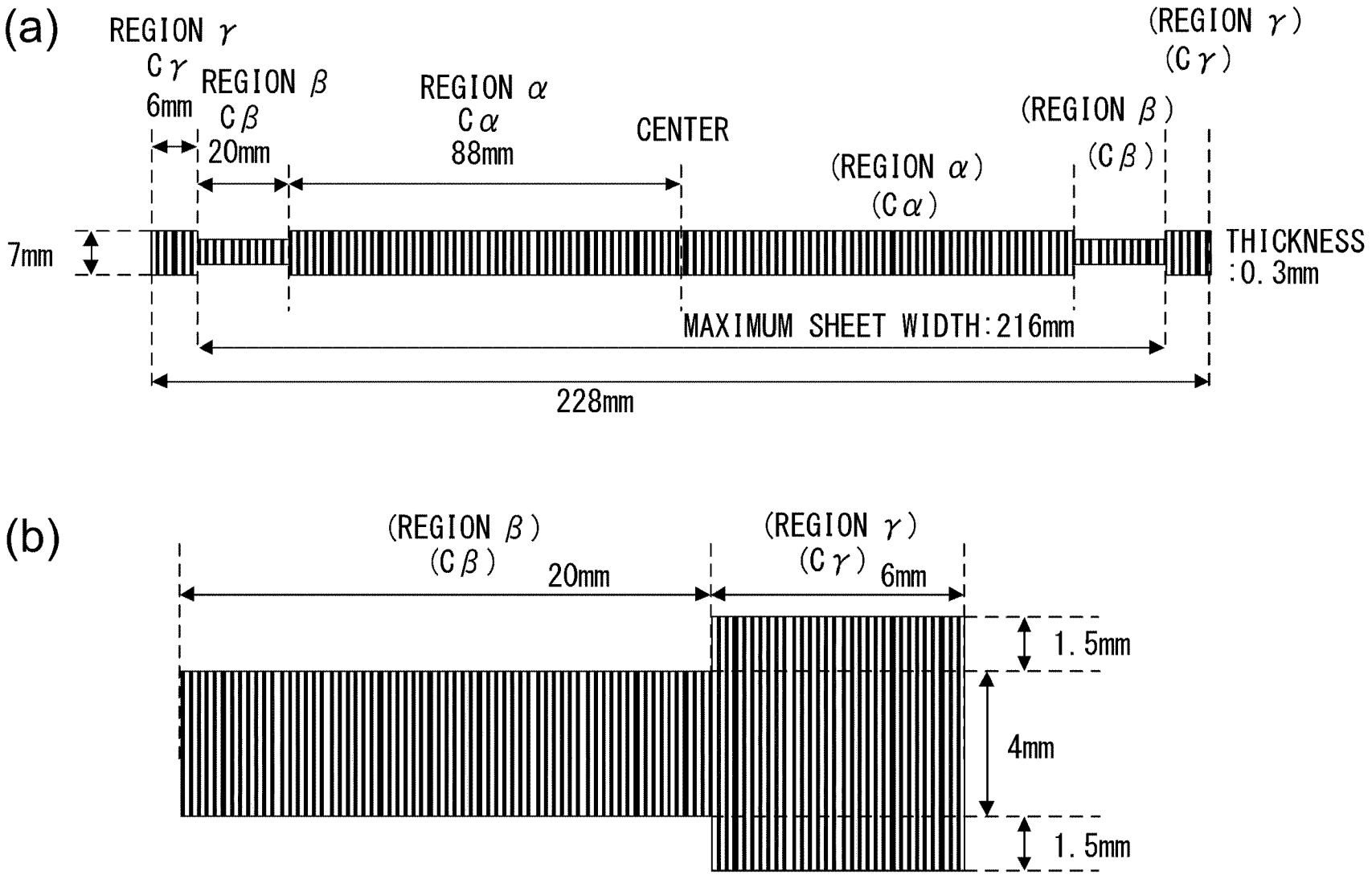

Parts (a) and (b) of FIG. 10 are schematic views showing another structure of the heat equalizing member in the embodiment.

Figure 11:
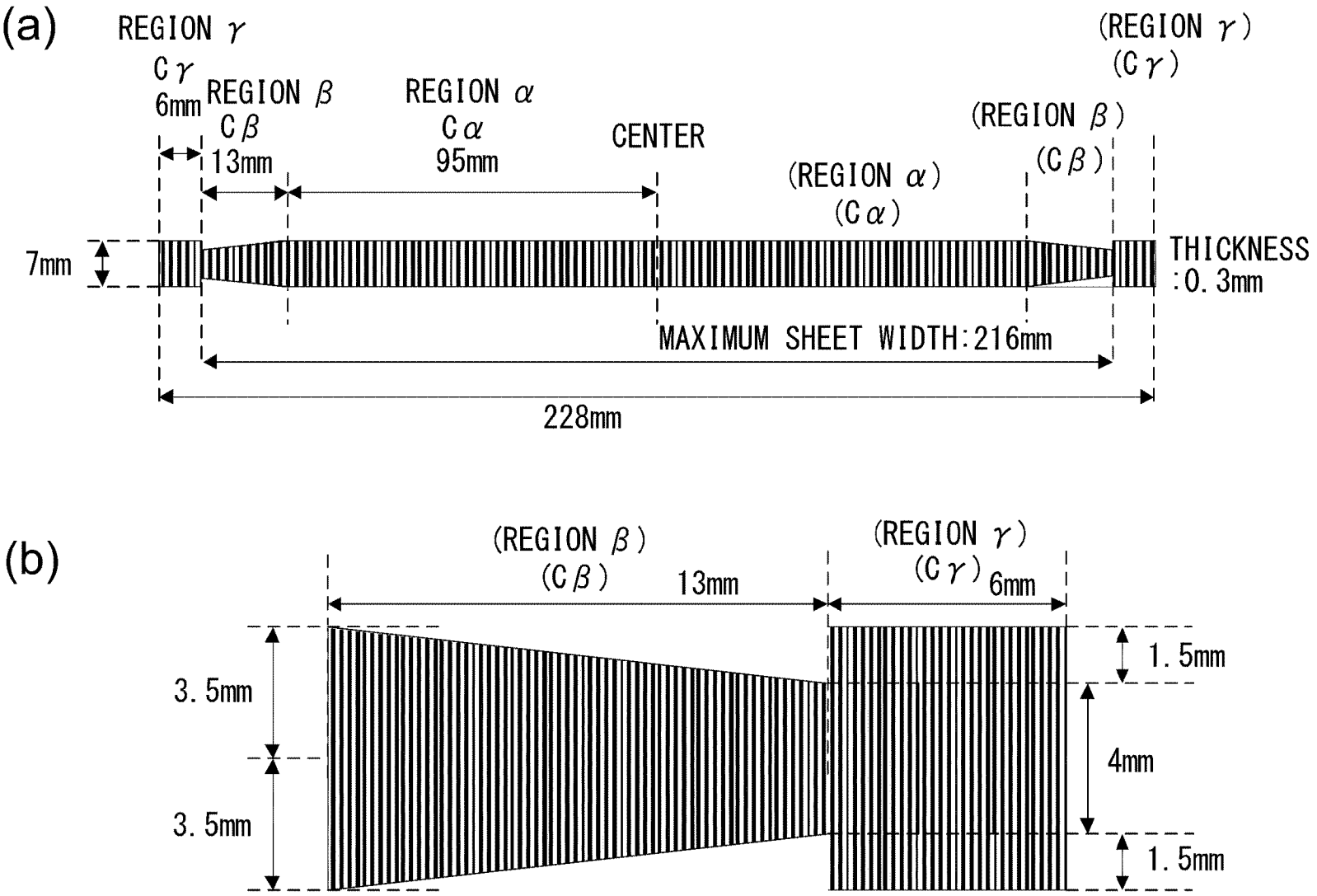

Parts (a) and (b) of FIG. 11 are schematic views showing another structure of the heat equalizing member in the embodiment.

DESCRIPTION OF THE EMBODIMENTS

In the following, embodiments of the present invention will be specifically described with reference to the drawings. In the following embodiments, passing of a recording material through a fixing nip is referred to as sheet (paper) passing. Further, in a region in which a heat generating member generates heat, a region in which the recording material does not pass is referred to as a non-sheet-passing region (or non-sheet-passing portion), and a region in which the recording material passes is referred to as a sheet passing region (sheet passing portion). Further, a phenomenon that the non-sheet-passing region is higher in temperature than the passing region is referred to as a non-sheet-passing portion temperature rise.

Embodiment

[Structure of Image Forming Apparatus]

Figure 1:
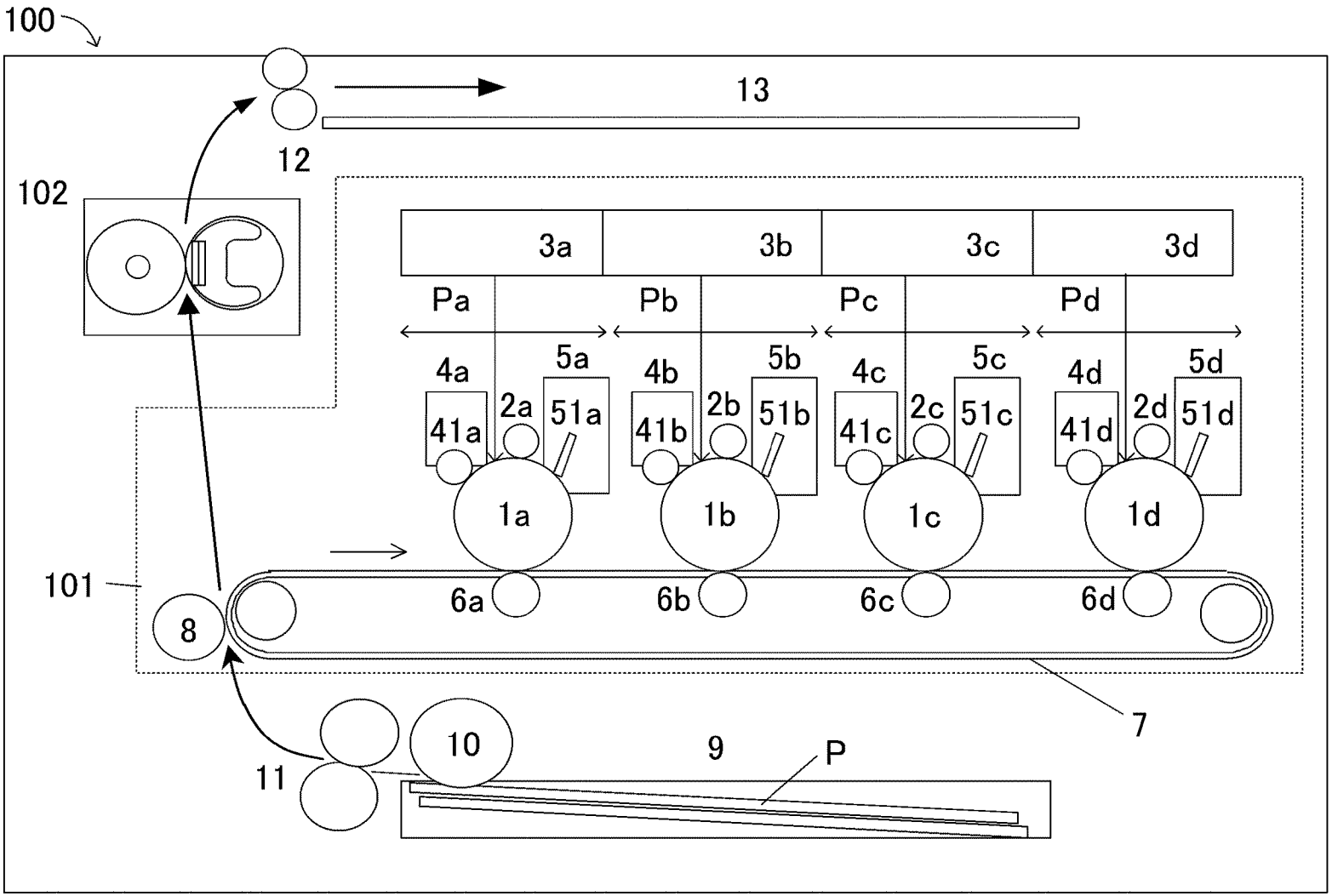
FIG. 1 is a schematic sectional view showing a structure of an image forming apparatus of an embodiment of the present invention.

FIG. 1 is a sectional view showing a structure of an image forming apparatus 100 including a fixing device 102 of this embodiment. In the image forming apparatus 100 shown in FIG. 1, an image forming portion 101 (portion enclosed by a dotted line) for forming toner images on a recording material P includes for image forming stations Pa, Pb, Pc and Pd for forming the toner images of yellow, magenta, cyan and black. The image forming portion 101 further includes laser scanners 3*a*, 3*b*, 3*c* and 3*d* provided correspondingly to the image forming stations Pa, Pb, Pc and Pd, respectively, and each for forming an electrostatic latent image on a photosensitive drum described later. The image forming stations Pa, Pb, Pc and Pd include cylindrical photosensitive drums 1*a*, 1*b*, 1*c* and 1*d* as image bearing members, charging rollers 2*a*, 2*b*, 2*c* and 2*d*, and developing devices 4*a*, 4*b*, 4*c* and 4*d* including developing rollers 41*a*, 41*b*, 41*c* and 41*d*. The respective image forming stations Pa, Pb, Pc and Pc have the same constitution, and a, b, c, and d added as suffixes to the respective members show that the members are those for the associated image forming stations Pa, Pb, Pc and Pd. In the following, the suffixes a, b, c, and d of reference numerals will be omitted except that the members represent those for a specific image forming station. The charging roller 2 electrically charges the photosensitive drum 1 to a uniform potential, and the photosensitive drum 1 charged to the uniform potential is irradiated with laser light depending on image data by the laser scanner 3, whereby the electrostatic latent image depending on the image data is formed on the photosensitive drum 1. Then, on the electrostatic latent image on the photosensitive drum 1, toner is deposited by the developing roller 41 of the developing device 4, so that a toner image is formed on the photosensitive drum 1. The toner images formed on the photosensitive drums 1 are successively transferred superposedly onto an intermediary transfer belt 7 rotating in an arrow direction (clockwise direction) by primary transfer rollers 6 provided at positions opposing the photosensitive drums 1, respectively. Incidentally, the toner image remaining on the photosensitive drum 1 without being transferred on the intermediary transfer belt 7 is removed by a cleaning blade 51 of a cleaner 5. The toner images transferred on the intermediary transfer belt 7 are moved toward a secondary transfer roller 8 in order to transfer the toner images onto the recording material P.

On the other hand, recording materials P are accommodated in a sheet feeding cassette 9 and are fed one by one to a feeding passage by a sheet feeding roller 10 when an image forming operation is started. The recording material P fed by the sheet feeding 10 is fed by a feeding roller pair 11 to a secondary transfer nip formed by contact between the intermediary transfer belt 7 and the secondary transfer roller 8, and in the secondary transfer nip, the toner images on the intermediary transfer belt 7 are transferred onto the recording material P.

The recording material P on which the toner images are transferred in the secondary transfer nip is fed to the fixing device 102 in which the toner images are heated and pressed and thus are fixed on the recording material P. Then, the recording material P passed through the fixing device 102 is discharged to a discharge portion 13 by a sheet discharging roller pair 12.

[Structure of Fixing Device]

Figure 2:
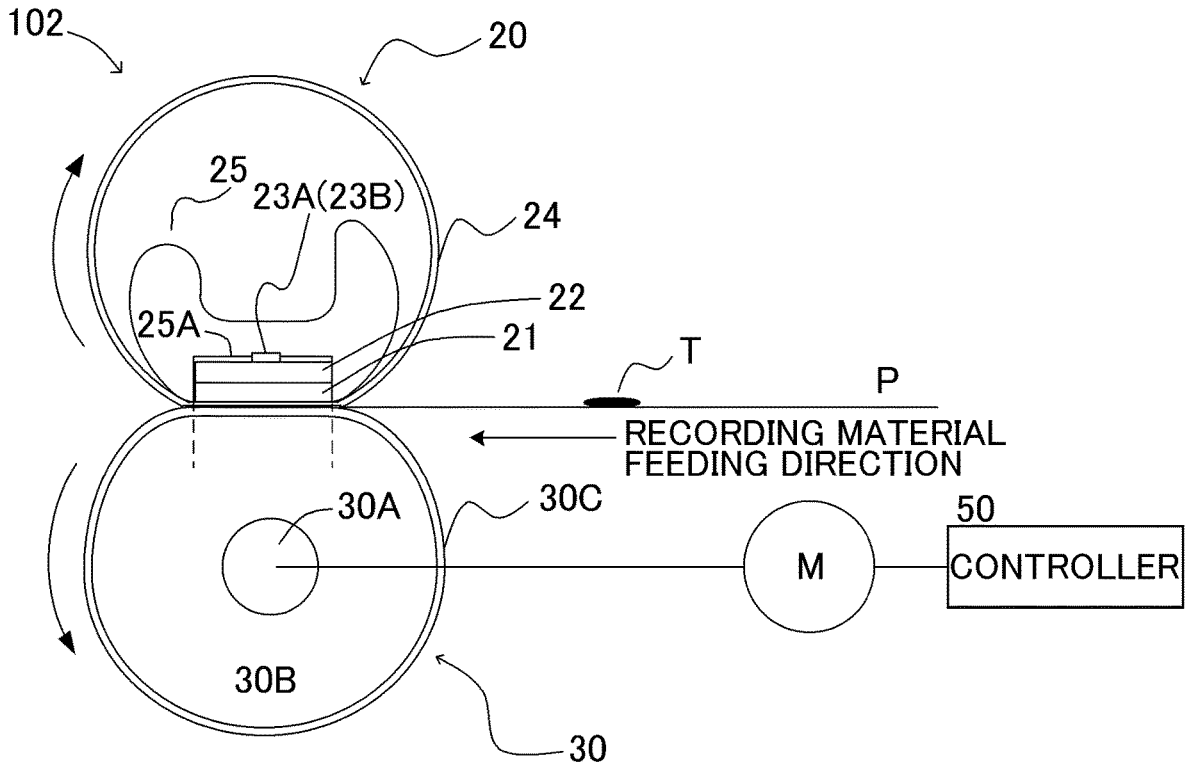
FIG. 2 is a sectional view showing a structure of fixing device of the embodiment.

FIG. 2 is a sectional view showing a general structure of the fixing device 102 of this embodiment. Part (a) of FIG. 3 is a schematic sectional view showing a general structure of a ceramic heater 21 used in the fixing device, and part (b) of FIG. 3 is a schematic view when the ceramic heater 21 is viewed from a (film) suppress side of a fixing film 24. Further, part (c) of FIG. 3 is a schematic view when a heat equalizing member (heat sink) 22 for equalizing a temperature distribution of the fixing film 24 is viewed from a (film) non-suppress side of the fixing film 24. FIG. 4 is a block diagram for illustrating a control system for controlling electric power supply to the ceramic heater 21.

As shown in FIG. 2, the fixing device 102 of this embodiment includes a heating unit 20 and a passing roller 30 as a rotatable passing member forming a fixing nip in cooperation with the fixing film 24. Each of the heating unit 20 and the passing roller 30 is a member elongated in a direction perpendicular to a recording material feeding direction which is a feeding direction of the recording material P to be fed. In the following, as regards members constituting the heating unit 20 and the passing roller 30, a direction perpendicular to the recording material feeding direction is referred to as a longitudinal direction, and a direction parallel to the recording material feeding direction is referred to as a widthwise direction.

(Heating Unit)

As shown in FIG. 2, the heating unit 20 includes the ceramic heater 21, the heat equalizing member 22, a thermistor 23, the cylindrical fixing film 24, and a fixing film guide 25. The fixing film guide 25 is formed with a heat-resistant material in a substantially recessed shape in cross section with respect to the widthwise direction. On a side where the fixing film guide 25 opposes the passing roller 30, a groove 25A is formed along the longitudinal direction, and the heater 21 and the heat equalizing member 22 are supported in the groove 25A of the fixing film guide 25.

Part (a) of FIG. 3 is an enlarged view of the heater 21 and the heat equalizing member 25 supported in the groove 25A of the fixing film guide 25 shown in FIG. 2, and at an upper portion (on the film non-suppress side) of the heat equalizing member 22, thermistors 23A and 23B for detecting a temperature of the heater 21 are provided. As shown in part (a) of FIG. 3, the heater 21 includes a thin plate-like substrate 21A principally comprising ceramic such as alumina or aluminum nitride. On a surface of the substrate 21A on the film side of the fixing film 24, along the longitudinal direction of the substrate 21A, a heat generating resistor 21B principally comprising silver, palladium, and the like is provided. Further, a protective layer 21C principally comprising glass or a heat-resistant material such as a fluorine-containing resin or polyimide is formed so as to cover the heat generating resistor 21B.

Part (b) of FIG. 3 is the schematic view when the heater 21 shown in part (a) of FIG. 3 is viewed from the suppress side of the fixing film 24, wherein a left-right direction in the figure is the longitudinal direction of the heater 21 and an up-down direction in the figure is the widthwise direction of the heater 21. As shown in part (b) of FIG. 3, on the substrate 21A on the suppress side of the fixing film 24, the heat generating resistor 21B, an electroconductive portion 21E electrically connected to the heat generating resistor 21B, and an electrode 21F for permitting a flow of a current through the electroconductive portion 21E are formed by pattern printing. Further, the protective layer 21C (indicated by a broken line in the figure) is formed so as to cover the heat generating resistor 21B and the electroconductive portion 21E which are formed on the substrate 21A.

On the other hand, part (c) of FIG. 3 is the schematic view when the heater 21 shown in part (a) of FIG. 3 is viewed from the non-suppress side of the fixing film 24, wherein the left-right direction in the figure is the longitudinal direction of the heater 21 and the up-down direction in the figure is the widthwise direction of the heater 21. As shown in part (c) of FIG. 3, on the non-suppress side of the substrate 21A, the heat equalizing member 22 is disposed, and a length of the heat equalizing member 22 with respect to the longitudinal direction is shorter than a length of the substrate 21A with respect to the longitudinal direction. Further, on the heat equalizing member 22, a main thermistor 23A and the sub-thermistor 23B which are used for detecting the temperature of the heater 21 through the heat equalizing member 23 are provided. The main thermistor 23A is disposed at a central portion of the heater 21 with respect to the longitudinal direction and detects the temperature of the heater 21 in a sheet passing region where the recording material P passes. On the other hand, the sub-thermistor 23B is disposed in the neighborhood of an end portion of the heat equalizing member 22 with respect to the longitudinal direction. The sub-thermistor 23B is provided for detecting the temperature in a non-sheet-passing region of the substrate 21A on a longitudinal end portion side where the recording material P does not pass when the image is printed on a small-size recording material P or when the image is printed on a large-size recording material P in a state in which the large-size recording material P is shifted to the longitudinal end portion side. Then, the temperature of the heater 21 in the non-sheet-passing region where the sheet does not pass is detected by the sub-thermistor 23B.

As shown in FIG. 2, the fixing film 24 is formed in a cylindrical shape so that an inner peripheral length of the film is longer than an outer peripheral length of the fixing film guide 25 by a predetermined length, and is externally fitted loosely on the fixing film guide 25 under no tension. The fixing film 24 has a two-layer structure in which an outer peripheral surface of a film base layer formed principally of polyimide in an endless left shape is covered with a surface layer formed principally of PFA in an endless belt shape.

(Pressing Roller)

As shown in FIG. 2, the passing roller 30 includes a core metal 30A comprising a metal material such as iron, SUS, or aluminum. Further, on an outer peripheral surface of a rotation shaft of the core metal 30A, an elastic layer 30B principally comprising a silicone rubber is formed, and further on an outer peripheral surface of the elastic layer 30B, parting layer 30C principally comprising PTFE, PFA, FEP, or the like is formed. Incidentally, opposite end portions of the core metal 30A with respect to the longitudinal direction are supported by a frame of the fixing device 102, and gears driven by a motor M are fixed thereto.

[Operation of Fixing Device]

Next, using FIGS. 2 and 4, a fixing (process) operation of the fixing device 102 will be described. In FIG. 2, a controller 50 for controlling the fixing device 102 includes a CPU (not shown), a ROM (not shown) storing programs and data executed by the CPU, and a RAM (not shown) used for temporarily storing data. The CPU of the controller 50 drives the motor M depending on a print signal for providing an instruction to start the image formation and causes the passing roller 30 to rotate in an arrow direction (counterclockwise direction) in the figure. With rotation of the passing roller 30, the fixing film 24 of the heating unit 20 rotates in an arrow direction (clockwise direction) while sliding on the heater 21 and the fixing film guide 25 at an inner peripheral surface (inner surface) thereof.

FIG. 4 is a block diagram for illustrating control of supply of electric power to the heater 21 by the controller 50. An AC voltage outputted from a commercial AC voltage (power) source 54 is supplied to the electrode 21F (part (b) of FIG. 3) via a triac 52. The AC voltage supplied to the electrode 21F is supplied to the heat generating resistor 21B through the electroconductive portion 21E (part (b) of FIG. 3), so that the heat generating resistor 21B generates heat by being supplied with the electric power. As a result, the heater 21 quickly increases in temperature and heats the fixing film 24 in the fixing nip. The controller 50 acquires, via an A/D conversion circuit 53, a detection temperature detected by the main thermistor 23A for detecting the temperature of the heater 21 through the heat equalizing member 22. Then, on the basis of the acquired detection temperature, the controller 50 carries out ON/OFF control of the triac 52 so that the heater 21 maintains a fixing temperature (target temperature), and thus controls an amount of electric power supplied from the commercial AC voltage source 54 to the heater 21.

As shown in FIG. 2, the recording material P on which the (unfixed) toner images T are transferred in the secondary transfer nip is heated by heat of the surface of the fixing film 24 while being nipped and fed by the passing roller 30 and the outer peripheral surface of the fixing film 24 in the fixing nip. By this, the (unfixed) toner images are fixed on the recording material P. Then, the controller 50 stops the drive of the motor M after the recording material P on which the toner images T are fixed passes through the fixing device 102 and turns off the triac 52, so that the controller 50 stops the supply of the electric power from the commercial voltage (power) source 54 to the heater 21.

[Relationship Between Countermeasure Against Non-Sheet-Passing Portion Temperature Rise and FPOT]

In the case where the small-size recording materials P narrower in width than the maximum sheet passing region are continuously passed through the fixing device 102, the temperature of the fixing film 24 is higher at the non-sheet-passing portion where the fixing film 24 is in non-contact with the recording material P than at the sheet passing portion where the fixing film 24 is in contact with the recording material P. For that reason, when wide recording materials P are passed through the fixing device 102 after an end of the passing of the small-size recording materials P, there is a problem that an image defect occurs due to a difference in fixing ratio caused by a temperature difference between the sheet passing portion and the non-sheet-passing portion. As a countermeasure against the non-sheet-passing portion temperature rise, there is a method in which the heat equalizing member 22 is disposed between the heater 21 and the fixing film guide 25, and the non-sheet-passing portion temperature rise can be further suppressed with a higher thermal conductivity of the heat equalizing member 22 used. On the other hand, in order to shorten the FPOT by shortening a rise time of the fixing device 102, a decrease in thermal capacity of the member contacting the heater 21 is effective. However, the use of the heat equalizing member 22 for the countermeasure against the non-sheet-passing portion temperature rise leads to extension of the rise time of the fixing device 102 due to taking of the heat by the heat equalizing member 22. That is, suppression of the non-sheet-passing portion temperature rise and shortening of the FPOT are in a trade-off relationship.

[Constitution of Heat Equalizing Member (Constitutional Embodiment 1)]

Part (a) of FIG. 5 is a schematic view showing a general structure (constitution) of the heat equalizing member 22 in a constitutional embodiment 1 of this embodiment shown in part (a) of FIG. 3, and part (b) of FIG. 5 is an enlarged schematic view of the heat equalizing member 22 in the neighborhood of a right-side end portion with respect to the longitudinal direction shown in part (a) of FIG. 5. As the heat equalizing member 22, a material excellent in thermal conductivity may desirably be used for uniformizing (equalizing) the temperature of the heater 21 with respect to the longitudinal direction. For that reason, as the heat equalizing member 22, a material, having a high thermal conductivity and a proper thermal capacity, which does not take heat more than necessary, including a metal material such as SUS, aluminum, aluminum alloy, copper, silver, gold, iron, carbon steel or graphite alloy or a carbon material such as a graphite sheet is used. In this embodiment, as the heat equalizing member 22, aluminum is used.

In part (a) of FIG. 5, a length of the heat equalizing member 22 with respect to the longitudinal direction (left-right direction in the figure) is 228 mm and is longer than a maximum size sheet width of 216 mm of the recording material P passing through the fixing device 102. Further, a length of the heat equalizing member 22 with respect to the widthwise direction (up-down direction in the figure) is 7 mm, and a thickness (plate thickness) of the heat equalizing member 22 is 0.3 mm. As shown in parts (a) and (b) of FIG. 5, the heat equalizing member 22 is provided with a rectangular opening 26, penetrating the heat equalizing member 22, which ranges from a position of the maximum size sheet width 6 mm inside each of longitudinal ends toward a longitudinal center side in a size of 20 mm with respect to the longitudinal direction and 4 mm with respect to the widthwise direction. Further, each of the openings 26 has a symmetrical shape with respect to a center of the heat equalizing member 22 with respect to the widthwise direction, and each of ends of the opening 26 with respect to the widthwise direction is positioned 1.5 mm inside the associated end of the heat equalizing member 22 with respect to the widthwise direction. Further, an end of the opening 26 closer to the longitudinal end of the heat equalizing member 22 is positioned 6 mm inside the longitudinal end of the heat equalizing member 22 so as to permit passing of the maximum size-recording material P. Further, the openings 26 are disposed in the neighborhood of opposite end portions (regions β described later) of the heat equalizing member 22 with respect to the longitudinal direction, and positions thereof are bilaterally symmetrical with respect to a longitudinal center of the heat equalizing member 22.

As shown in part (a) of FIG. 5, in this embodiment, with a longitudinal center axis of the heat equalizing member 22 as a boundary, a region of the heat equalizing member 22 is divided into three regions consisting of a region α, a region β, and a region γ from the longitudinal center axis toward the longitudinal end of the heat equalizing member 22. Specifically, the region α is a region from the longitudinal center axis to a position of 88 mm therefrom a boundary between the regions α and β of the heat equalizing member 22, and the region β is a region from a longitudinal end of the region α to a position of 20 mm therefrom to a boundary between the regions β and γ of the heat equalizing member 22. Further, the region γ is a region from the longitudinal end of the region β to a position of 6 mm therefrom to the longitudinal end of the heat equalizing member 22. Incidentally, the above-described opening 26 is provided in the region β. When thermal capacities per unit length of the regions α, β and γ of the heat equalizing member 22 are Cα, Cβ and Cγ, respectively, (thermal capacity Cα)>(thermal capacity Cβ) and (thermal capacity Cγ)>(thermal capacity Cβ) hold. That is, the thermal capacity Cβ in the region β is smaller than the thermal capacity Cα in the region α and than the thermal capacity Cγ in the region γ by providing the opening 26. Further, in parts (a) and (b) of FIG. 5, the heat equalizing member 22 has a bilaterally symmetrical shape with respect to the longitudinal center thereof, and therefore, the regions α, β and γ disposed at mirror image positions and the thermal capacities Cα, Cβ and Cγ per unit length at the mirror image positions are indicated in parentheses.

[Difference in Temperature Profile of Fixing Film Due to Constitution of Heat Equalizing Member]

As regards the suppression of the non-sheet-passing portion temperature rise and the shortening of the FPOT which are in the trade-off relationship, by using the heat equalizing member 22 shown in FIG. 5 in this embodiment, it is possible to not only suppress the non-sheet-passing portion temperature rise but also shorten the FPOT, so that the above-described problem can be solved.

FIG. 6 is a graph schematically illustrating a longitudinal temperature profile of the fixing film 24 immediately before a first recording material P (sheet) reaches the fixing nip in the fixing device 102 caused to rise from a room temperature. An upper portion of FIG. 6 is a schematic view showing a constitution (structure) of the heat equalizing member 22 in a constitutional embodiment ("CONS EMB. 1") of this embodiment, a constitution (structure) of a heat equalizing member 22 in a conventional example ("CONV. EX"), and a positional relationship therebetween. In the graph of FIG. 6, the ordinate represents the temperature (unit: ° C.) of the fixing film 24, and the abscissa represents a longitudinal position of each of the heat equalizing members 22 according to this embodiment and the conventional example. In FIG. 6, the graph indicated by a solid line represents the longitudinal temperature profile of the fixing film 24 in the case where the conventional heat equalizing member provided with no opening was used. On the other hand, the graph indicated by a broken line represents the longitudinal temperature profile of the fixing film 24 in the case where the heat equalizing member 22 in this embodiment shown in FIG. 5.

With reference to FIG. 6, a mechanism capable of not only achieving a heat (temperature) equalizing effect of the heat equalizing member 22 in this embodiment but also shortening the FPOT will be described. As shown in FIG. 6, in the longitudinal temperature profile of each of the heat equalizing member 22 in this embodiment and the conventional heat equalizing member 22, by heat dissipation and heat diffusion, the temperature lowers from the longitudinal center toward the longitudinal end portion of the fixing film 24. However, the temperature profile in the case where the heat equalizing member 22 in this embodiment is used is such that compared with the temperature profile in the case where the conventional heat equalizing member 22 is used, a degree of a lowering in temperature at each of longitudinal end portions of the fixing film 24 is small. During the temperature rise of the fixing device 102, the heat equalizing member 22 adjacent to the heater 21 takes the heat of the heater 21. However, the heat equalizing member 22 according to this embodiment includes the region β which is the longitudinal end portion, in which the thermal capacity Cβ per unit length is smaller than the thermal capacity Cα in the region α and than the thermal capacity Cγ in the region γ, and therefore, a heat quantity in the region β in which the heat is taken from the heater 21 is also smaller than a heat quantity in each of the regions α and γ. By this, in the case where the heat equalizing member 22 in this embodiment is used, a high temperature is realized at each of the longitudinal end portions of the fixing film 24.

In general, a rising time of the heater 21 is set so that even the toner image transferred on a region of the maximum size-recording material P where the temperature is lowest is fixed on the recording material P by being passed through the fixing device 102. However, when a fixable temperature in a state shown in the graph of FIG. 6 is 180° C., in the case where the conventional heat equalizing member 22 is used, there is a need to extend the rising time until the temperature at each of the longitudinal end portions (i.e., magnitude size sheet width portions of the recording material P) increases from 170° C. to 180° C. On the other hand, in the case where the heat equalizing member 22 in this embodiment is used, in the state shown in the graph of FIG. 6, the temperature at each of the magnitude size sheet portions of the recording material P is 180° C. which is the fixable temperature, and therefore, it is possible to not only achieve the heat equalizing effect but also shortening the FPOT when compared with the conventional example. Further, in order to obtain a sufficient heat equalizing effect, it is also important that a position where the region β of the heat equalizing member 22 including the opening 26 is disposed is caused to fall within the magnitude size sheet width portions of the recording material P feedable through the fixing device 102. This is because the heat equalizing member 22 in a region (adjacent to the heater 21 in the region γ of the heat equalizing member 22) adjacent to a region which is the non-sheet-passing region and in which the heater 21 is provided has a sufficient thermal capacity Cγ, and thus an effect such that the non-sheet-passing portion temperature rise is further suppressed can be achieved.

[Measurement of Thermal Capacity of Heat Equalizing Member]

The thermal capacity of the heat equalizing member 22 is represented by the product of weight and specific heat of a material used, and therefore, the thermal capacity per unit length of the heat equalizing member 22 with respect to the longitudinal direction can be calculated by the following (formula 1).

Thermal capacity per unit length=(specific heat at constant pressure)×(weight)/(longitudinal length) (formula 1)

Incidentally, the specific heat at constant pressure can be acquired by using a differential scanning calorimeter (tradename: "DSC823e", manufactured by METTLER TOLEDO K.K.). The thus-calculated values of the thermal capacity per unit length (unit: J/K·m) in the regions α, β and γ of the heat equalizing member 22 in this embodiment are shown in a table 1 below. In the table 1, the values of the thermal capacity per unit length of the heat equalizing member 22 in the regions α and γ with respect to the longitudinal direction are equal to each other. Further, the thermal capacity per unit length of the heat equalizing member 22 in the region β with respect to the longitudinal direction is smaller than each of the values of the thermal capacity in the regions α and γ since the heat equalizing member 22 includes the opening 26 in the region β, so that the thermal capacity in the region β in a thermal capacity depending on an areal ratio between the opening and the heat equalizing member.

TABLE 1

| | REGION | TCPUL*1 (J/K · m) |
|---|---|---|
| HEM*2 | α | 4.99 |
| | β | 2.14 |
| | γ | 4.99 |

*1"TCPUL" is the thermal capacity per unit length.
*2"HEM" is the heat equalizing member 22.

[Measurement of Thermal Conductivity of Heat Equalizing Member]

For measurement of the thermal conductivity in this embodiment, a nonconstant heater wire method was used. Specifically, by the nonconstant heater wire method (probe method) using a measuring provided ("QTM-500", manufactured by KYOTO ELECTRONICS MANUFACTURING CO., LTD.), measurement of the thermal conductivity was carried out, and a probe ("PD-13") was used. The thermal conductivity S can be calculated by the following (formula 2).

$$\lambda = \frac{Q}{4\pi} \cdot \frac{\ln\left(\frac{t_2}{t_1}\right)}{T_2 - T_1} \quad \text{(formula 2)}$$

In the (formula 2), Q represents a heater unit time, heat value for length of unit, and T1 and T2 are temperatures at measurement times t1 and t2, respectively.

On the basis of measurement result, a temperature rising curve is plotted, in which the abscissa represents a time t scaled in logarithm, and the ordinate represents a temperature rise ΔT, and then plotted points are connected, so that a rectilinear line is obtained. From a slope of the rectilinear line, the thermal capacity is acquired. Values of the thermal conductivity of the heat equalizing member 22 and the heater 21, obtained on the basis of the measurement result are shown in a table 2 below. In the table 2, for the regions α, β and γ of the heat equalizing member 22 and the heater 21, materials and values of the thermal conductivity (unit: W/m·K) are shown. The material of the heat equalizing member 22 is aluminum, but the heat equalizing member 22 is provided with the opening 26 in the region β, and therefore the material contains the air. Further, the material of the heater 21 is alumina, glass, or the like. As shown in the table 2, the values of the thermal conductivity of the heat equalizing member 22 in the regions α and γ are equal to each other, and the thermal conductivity in the region β is smaller than each of the values of the thermal conductivity in the regions α and β since the opening 26 is formed in the region β, so that the thermal conductivity in the region β is a thermal conductivity depending on an areal ratio between the opening and the heat equalizing member.

TABLE 2

| | REGION | MATERIAL*1 | TC*2 (W/m · K) |
|---|---|---|---|
| HEM*3 | α | Al | 236 |
| | β | Al/Air | 102 |
| | γ | Al | 236 |
| HEATER | | AL/G | 30 |

*1"AL" is aluminum, Al/Air is aluminum/air, and "AL/G" is alumina/glass or the like.
*2"TC" is the thermal conductivity.
*3"HEM" is the heat equalizing member 22.

Then, in order to quantitatively measure an effect of the constitution (constitutional embodiment 1) of the heat equalizing member 22 in this embodiment shown in FIG. 5, measurement of the non-sheet-passing portion temperature rise and measurement of the FPOT are carried out. Incidentally, as described later, in order to compare the effect of the constitutional embodiment 1 with other embodiment and examples, similar measurements were carried out also in a constitutional embodiment 2 different in constitution from the constitutional embodiment 1, a comparison example in which the constitution of the constitutional embodiment 1 is changed, and the conventional example in which the conventional heat equalizing member is used.

[Measurement of Non-Sheet-Passing Portion Temperature Rise]

In the image forming apparatus 100, in an environment of a temperature of 15° C. and a relative humidity of 10% RH, measurement of the non-sheet-passing portion temperature rise was carried out in a state in which the fixing device 102 in which the heat equalizing member 22 to be subjected to the measurement is sufficiently cooled. In this measurement, a surface temperature of the fixing film 24 was measured in the case where 200 sheets of A4 size-color laser NPI quality thick papers (available from Canon K.K.) with a basis weight of 128 g/m$^2$ are continuously subjected to printing of images thereon at a maximum throughput. Originally, in the case where a recording material with a large basis weight such as the color laser NPI quality thick paper is used, a method in which sheet passing is carried out at a lowered throughput is a proper operation method. In this experiment, printing was intentionally carried out at the maximum throughput on the assumption that a user erroneously inputted information on the basis weight of the recording material. Maximum temperatures of the measured surface temperatures of the fixing film 24 are classified into the following ranks A to D. The surface temperatures of the fixing film 24 belonging to the rank B or higher, i.e., belonging to the rank A and the rank B were evaluated as a good result of suppression of the non-sheet-passing portion temperature rise.

(Rank A): 231° C. to 235° C.

(Rank B): 236° C. to 240° C.

(Rank C): 241° C. to 245° C.

(Rank D): 246° C. to 250° C.

[Measurement of FPOT]

In the image forming apparatus 100, in the environment of the temperature of 15° C. and the relative humidity of 10% RH, measurement of the FPOT was carried out in the state in which the fixing device 102 in which the fixing device 102 in which the heat equalizing member 22 to be subjected to the measurement is sufficiently cooled. In this measurement, in the case where a single sheet of letter (LTR) size-LASER JET PAPER (available from Hewlette-Packard Company) with a basis weight of 90 g/m$^2$ was subjected to printing of the image thereon at a maximum through put, a time from a start of the printing to an end (completion) of the printing was measured. However, in the measurement of the FPOT, in order to equalize a fixing property even in any constitution of the heat equalizing member 22, a time until the recording material enters the fixing device 102 was changed. For that reason, in the fixing device 102, in the case of the heat equalizing member 22 having a constitution in which the thermal capacity per unit length in the region β is large, the temperature of the heat equalizing member 22 at the longitudinal end portion does not readily increase. As a result, the time until the recording material enters the fixing device 102 is increased, so that the FPOT becomes long. The time required from the start of the printing to the completion of the printing was classified into the following ranks A to D, in which the rank B or higher, i.e., the rank A and the rank B were evaluated as a good result of shortening of the FPOT.

(Rank A): 9.6 sec to 10.0 sec (Rank B): 10.1 sec to 10.5 sec (Rank C): 10.6 sec to 11.0 sec (Rank D): 11.1 sec to 11.6 sec Incidentally, in order to perform comparison with the experimental result of the above-described constitutional embodiment 1 shown in FIG. 5, the measurement of the non-sheet-passing portion temperature rise and the measurement of the FPOT were also carried out for the constitutional embodiment 2 different in constitution from the constitutional embodiment 1, the comparison example in which the constitution of the constitutional embodiment 1 is changed, and the conventional example in which the conventional heat equalizing member is used, which are described below.

[Constitution of Heat Equalizing Member (Constitutional Embodiment 2)]

Parts (a) and (b) of FIG. 6 are schematic views showing a constitution (constitutional embodiment 2) of the heat equalizing member 22 which is in accordance with the constitution of the constitutional embodiment 1 of the heat equalizing member 22 shown in FIG. 5 but which is different in constitution from the constitutional embodiment 1. Part (a) of FIG. 7 is the schematic view showing a general structure (constitution) of the heat equalizing member 22 in the constitutional embodiment 2 of this embodiment, and part (b) of FIG. 7 is an enlarged schematic view of the heat equalizing member 22 in the neighborhood of a right-side end portion with respect to the longitudinal direction shown in part (a) of FIG. 7.

In part (a) of FIG. 7, a length of the heat equalizing member 22 with respect to the longitudinal direction (left-right direction in the figure) is 228 mm, a length of the heat equalizing member 22 with respect to the widthwise direction (up-down direction in the figure) is 7 mm, and a thickness (plate thickness) of the heat equalizing member 22 is 0.3 mm. A size of the heat equalizing member 22 is the same as the size of the heat equalizing member 22 in the constitutional embodiment 1. Further, a region of the heat equalizing member 22 in the constitutional embodiment 2 is also divided into three regions consisting of a region &6*a*&, a region β, and a region γ. Specifically, the region α is a region from the longitudinal center axis to a position of 95 mm therefrom a boundary between the regions α and β of the heat equalizing member 22, and the region β is a region from a longitudinal end of the region α to a position of 13 mm therefrom to a boundary between the regions β and γ of the heat equalizing member 22. Further, the region γ is a region from the longitudinal end of the region β to a position of 6 mm therefrom to the longitudinal end of the heat equalizing member 22. Sizes of the regions α of the heat equalizing members 22 in the constitutional embodiments 1 and 2 are 88 mm and 95 mm, respectively, sizes of the regions β of the heat equalizing members 22 in the constitutional embodiments 1 and 2 are 20 mm and 13 mm, respectively, and each of sizes of the regions γ of the heat equalizing members 22 in the constitutional embodiments 1 and 2 is 6 mm. The sizes of the regions α and β are different between the constitutional embodiments 1 and 2, but the sizes of the regions γ and the same between the constitutional embodiments 1 and 2. When thermal capacities per unit length of the regions α, β and γ of the heat equalizing member 22 in the constitutional embodiment 2 are Cα, Cβ and Cγ, respectively, (thermal capacity Cα)>(thermal capacity Cβ) and (thermal capacity Cγ)>(thermal capacity Cβ) hold. That is, the thermal capacity Cβ in the region β is smaller than the thermal capacity Cα in the region α and than the thermal capacity Cγ in the region γ.

Further, as shown in FIG. 7, the heat equalizing member 22 in the constitutional embodiment 2 is provided with an opening 27, having an isosceles triangular shape of 20 mm in height with respect to the longitudinal direction and 4 mm in base with respect to the widthwise direction, is provided from a maximum size sheet width position which is 6 mm inside each of longitudinal opposite ends toward a longitudinal center. Further, each of the openings 27 has a symmetrical shape with respect to a center axis of the heat equalizing member 22 with respect to the widthwise direction. Further, a longitudinal end (corresponding to the base of the isosceles triangular shape) of the openings 27 close to the associated longitudinal end portion of the heat equalizing member 22 is positioned 6 mm inside the longitudinal end of the heat equalizing member 22 so as to permit passing of the recording material P having the maximum size sheet width. Thus, the openings 27 are disposed in the neighborhood of the opposite end portions of the heat equalizing member 22, and positions thereof are bilaterally symmetrical with respect to a longitudinal center of the heat equalizing member 22 as an axis. Thus, a constitution in which the thermal capacity per unit length decreases toward each of the longitudinal end portions in the regions β of the heat equalizing member 22 in the constitutional embodiment 2 is employed. On the other hand, in the constitutional embodiment 1, a constitution in which the thermal capacity per unit length is constant in the regions β of the heat equalizing member 22. An insufficient heat quantity at the longitudinal end portion of the fixing film 24 during rising of the fixing device 102 appears conspicuously toward an extreme longitudinal end. On the other hand, on a center side than the extreme longitudinal end of the fixing film 24, the insufficient heat quantity is small. In the constitutional embodiment 2, in conformity to a gradient of the heat quantity, a gradient is provided to the thermal capacity of the heat equalizing member 22 in the region β, so that an effect of suppressing the non-sheet-passing portion temperature rise is achieved.

Incidentally, in parts (a) and (b) of FIG. 7, the heat equalizing member 22 has a bilaterally symmetrical shape with respect to the longitudinal center thereof, and therefore, the regions α, β and γ disposed at mirror image positions and the thermal capacities Cα, Cβ and Cγ per unit length at the mirror image positions are indicated in parentheses.

[Constitution of Heat Equalizing Member in Conventional Example]

FIG. 8 is a schematic view showing a structure (constitution) of the heat equalizing member 22 in the conventional example. In part (a) of FIG. 8, a length of the heat equalizing member 22 with respect to the longitudinal direction (left-right direction in the figure) is 228 mm, a length of the heat equalizing member 22 with respect to the widthwise direction (up-down direction in the figure) is 7 mm, and a thickness (plate thickness) of the heat equalizing member 22 is 0.3 mm. A size of the heat equalizing member 22 in the conventional example is the same as each of the sizes of the heat equalizing members 22 in the constitutional embodiments 1 and 2. Further, the heat equalizing member 22 in the conventional example is different from the heat equalizing members 22 in the constitutional embodiments 1 and 2, i.e., a constitution in which the openings are not provided in the regions β and in which the thermal capacities Cα, Cβ, Cγ in the regions α, β and γ are the same and thus there is no change in thermal capacity with respect to the longitudinal direction is employed. For that reason, in this constitution, during the rising of the fixing device 102, at the longitudinal end portions of the fixing film 24, the heat of the heater 21 is taken by the heat equalizing member 22 and thus this constitution is disadvantageous in shortening of the FPOT. Incidentally, in FIG. 8, the heat equalizing member 22 has a bilaterally symmetrical shape with respect to the longitudinal center thereof, and therefore, the regions α, β and γ disposed at mirror image positions and the thermal capacities Cα, Cβ and Cγ per unit length at the mirror image positions are indicated in parentheses.

[Constitution of Heat Equalizing Member in Comparison Example]

FIG. 9 is a schematic view showing a constitution (comparison example) of the heat equalizing member 22 which is in accordance with the constitutions of the constitutional embodiments 1 and 2 of the heat equalizing members 22 shown in FIGS. 5 and 7 but which is different in constitution from the constitutional embodiments 1 and 2.

In FIG. 9, a length of the heat equalizing member 22 with respect to the longitudinal direction (left-right direction in the figure) is 228 mm, a length of the heat equalizing member 22 with respect to the widthwise direction (up-down direction in the figure) is 7 mm, and a thickness (plate thickness) of the heat equalizing member 22 is 0.3 mm. A size of the heat equalizing member 22 is the same as the sizes of the heat equalizing members 22 in the constitutional embodiments 1 and 2. Further, a region of the heat equalizing member 22 in the comparison example is also divided into three regions consisting of a region &6*a*&, a region β, and a region γ. Specifically, the region α is a region from the longitudinal center axis to a position of 95 mm therefrom a boundary between the regions α and β of the heat equalizing member 22, and the region β is a region from a longitudinal end of the region α to a position of 13 mm therefrom to a boundary between the regions β and γ of the heat equalizing member 22. Further, the region γ is a region from the longitudinal end of the region β to a position of 6 mm therefrom to the longitudinal end of the heat equalizing member 22. Sizes of the regions α, β and γ are different from those in the constitutional embodiment 1 but are the same as those in the constitutional embodiment 2.

Further, as regards the region β, the openings are provided in both of the constitutional embodiments 1 and 2, but in the comparison example, the region β separates the regions α and γ, so that different from the constitutional embodiments 1 and 2, the regions α and γ are not connected by the heat equalizing member 22. As a result, the constitution of the comparison example is such that longitudinal end portion regions of the heat equalizing member 22 are heated due to the non-sheet-passing portion temperature rise but the heat at each of the longitudinal end portions is not readily conducted toward the longitudinal central portion. Incidentally, in FIG. 9, the heat equalizing member 22 has a bilaterally symmetrical shape with respect to the longitudinal center thereof, and therefore, the regions α, β and γ disposed at mirror image positions and the thermal capacities Cα, Cβ and Cγ per unit length at the mirror image positions are indicated in parentheses.

[Evaluation Result of Non-Sheet-Passing Portion Temperature Rise and FPOT in Fixing Devices in which Heat Equalizing Members are Mounted]

A table 3 shown below is a table providing a summary of measurement results maximum temperatures of the fixing films 24 due to the non-sheet-passing portion temperature rise and the FPOT, obtained by using the fixing devices in which the heat equalizing members 22 having the above-described constitutions are mounted, and of evaluation results based on the measurement results.

TABLE 3

| | Cα (J/K · m) | Cβ (J/K · m) | cγ (J/K · m) | Cα > Cβ & Cγ > Cβ | HEMHD/HHDIN REGION B*1 | NSPPTR *2 (° C.) | FPOT*3 (SEC) |
|---|---|---|---|---|---|---|---|
| CONSTITUTION EMB. 1 | 4.99 | 2.14 | 4.99 | ○ | ○ | A: 235 | A: 10.0 |
| CONSTITUTION EMB. 2 | 4.99 | 2.67 | 4.99 | ○ | ○ | A: 232 | A: 10.0 |

TABLE 3-continued

| | Cα (J/K · m) | Cβ (J/K · m) | cγ (J/K · m) | Cα > Cβ & Cγ > Cβ | HEMHD/HHDIN REGION B*1 | NSPPTR *2 (° C.) | FPOT*3 (SEC) |
|---|---|---|---|---|---|---|---|
| CONVENTIONAL EX. | 4.99 | 4.99 | 4.99 | X | ○ | A: 231 | A: 11.5 |
| COMPARISON EX. | 4.99 | 0.00 | 4.99 | ○ | X | D: 250 | A: 9.8 |

*1: "HEMHD > HHD IN REGION β" is (HEATEQUALIZING MEMBER HEAT CONDUCTIVITY) > (HEATER HEAT CONDUCTIVITY) IN REGION β.
*2: "NSPPTR" is the non-sheet-passing portion temperature rise.
*3: "FPOT" is the first print out time.

In the table 3, the measurement results and the evaluation results as to the constitutional embodiment 1, the constitutional embodiment 2, the conventional example, and the comparison example are shown from above, respectively, in a named order. Further, in the table 3, in the order from a left-hand side, items including the values of thermal capacity per unit length Cα, Cβ and Cγ (unit: J/K·m) in the regions α, β and γ, a magnitude relationship between the thermal capacities Cα, Cβ and Cγ, and a magnitude relationship between the thermal capacity of the heat equalizing member 22 in the region β and the thermal capacity of the heater 21 in the region β are shown. Further, in the table 3, in right-hand items, the evaluation result and the measurement result of the non-sheet-passing portion temperature rise (unit: ° C.), and the evaluation result and the measurement result of the FPOT (unit: sec) are shown.

As shown in table 3, as regards the thermal capacity Cα in the region α, the same thermal capacity is obtained in all the embodiments and examples. As regards the thermal capacity Cβ in the region β, the thermal capacity in the constitutional embodiment 1 is smaller than the thermal capacity in the constitutional embodiment 2, and the thermal capacity in the comparison example is 0.00 since there is no heat equalizing member in the region β. Incidentally, in the conventional example, there is no opening in the region β, the thermal capacity is the same as the thermal capacity in the region α. Further, as regards the thermal capacity Cγ in the region γ, the thermal capacities in the constitutional embodiment 1, the constitutional embodiment 2, the conventional example, and the comparison example are the same.

As regards the magnitude relationship between the thermal capacities Cα, Cβ and Cγ, whether or not a condition of Cα>Cβ and Cγ>Cβ is satisfied is represented by o (satisfied) or x (not satisfied). As shown in table 3, in the constitutional embodiments 1 and 2 and the comparison example, the condition is satisfied, but in the conventional example, the condition is not satisfied since the thermal capacity Cβ in the region β is the same as the thermal capacity Cα in the region α and the thermal capacity Cγ in the region γ. Further, as regards the magnitude relationship between the thermal conductivities of the heat equalizing member 22 and the heater 21 in the region β, whether or not a condition of (thermal conductivity of heat equalizing member 22)>(thermal conductivity of heater 21) is satisfied is represented by o (satisfied) or x (not satisfied). As shown in the table 2, in the constitutional embodiments 1 and 2 and the conventional example, the condition is satisfied, but in the comparison example, the condition is not satisfied since the thermal conductivity in the region β is 0.00 but the thermal conductivity of the heater 21 is 30 W/m·K from the table 2.

Further, as regards the measurement result and the evaluation result of the non-sheet-passing portion temperature rise, 235° C. and the rank A in the constitutional embodiment 1, 232° C. and the rank A in the constitutional embodiment 2, 231° C. and the rank A in the conventional example, and 250° C. and the rank D in the comparison example. As regards the measurement result and the evaluation result of the FPOT (unit: sec), 10.0 sec and the rank A in the constitutional embodiment 1, 10.0 sec and the rank A in the constitutional embodiment 2, 11.5 sec and the m. K rank D in the conventional example, and 9.9 sec and the rank A in the comparison example.

(Evaluation of Constitutional Embodiment 1)

In the constitutional embodiment 1 shown in FIG. 5, thermal capacities per unit length of the heat equalizing member 22 satisfy Cα>Cβ and Cγ>Cβ, and further, the regions β each provided with the opening and disposed inside a range of the maximum size sheet width of the recording material P capable of passing through the fixing device 102. As a result, as shown in the table 3, both the evaluation results of the non-sheet-passing portion temperature rise and the FPOT are the rank A.

(Evaluation of Constitutional Embodiment 2)

In the constitutional embodiment 2 shown in FIG. 7, the shape of each of the openings provided in the regions β of the heat equalizing member 22 is the isosceles triangular shape such that the widthwise length increases toward the longitudinal end portion. For that reason, the thermal capacity per unit length in the region β decreases toward the longitudinal end portion. Thus, during the rising of the fixing device 102, in conformity to the gradient of the thermal capacity insufficient at the longitudinal end portion of the fixing film 24, the gradient is provided to the thermal capacity of the heat equalizing member 22 in the region β, so that the FPPOT does not increase and thus the maximum temperature during the non-sheet-passing portion temperature rise can be lowered. As a result, as shown in the table 3, both the evaluation results of the non-sheet-passing portion temperature rise and the FPOT become the ranks A.

(Evaluation of Conventional Example)

In the constitution of the conventional example shown in FIG. 8, the opening is not provided, and therefore, the thermal capacity is the same in the respective regions of the heat equalizing member 22 and thus there is no change in thermal capacity. Different from the constitutional embodiments 1 and 2, the heat equalizing member 22 is not provided with the opening, and therefore, the evaluation result of the non-sheet-passing portion temperature rise becomes the rank A, so that the constitution of the conventional example is effective in suppressing the non-sheet-passing portion temperature rise. On the other hand, during the rising of the fixing device 102, the heat of the heater 21 is taken (moved) at the longitudinal end portion by the heat equalizing member 22 in a longer amount than in the constitutional embodiments 1 and 2, so that the longitudinal end portion through of the fixing film 24 does not readily increase. As a result, compared with the FPOT (10 sec) in the constitutional embodiments 1 and 2, the FPOT in the conventional example is increased to 11.5 sec, so that the evaluation result becomes the rank D.

(Evaluation of Comparison Example)

In the constitution of the comparison example shown in FIG. 9, the region α and the region γ of the heat equalizing member 22 are separated from each other by the region β where there is no heat equalizing member 22. For that reason, during the rising of the fixing device 102, the heat of the heater 21 is not readily taken by (conducted to) the heat equalizing member 22 at the longitudinal end portion, so that the temperature of the fixing film 24 at the longitudinal end portion easily increases, and therefore, the FPOT is shortest, i.e., 9.8 sec, and thus the evaluation result is the rank A. On the other hand, the region α and the region γ are not connected via the heat equalizing member 22. For that reason, when the heat equalizing member 22 is heated, due to the non-sheet-passing portion temperature rise, in the region γ positioned outside the maximum size sheet width range of the recording material P capable of being passed through the fixing device 102, the thermal capacity Cβ in the region β is small, i.e., 0.00, and therefore, the heat equalizing effect is not readily obtained. As a result, the maximum temperature during the non-sheet-passing portion temperature rise increases to 250° C., and thus the evaluation result becomes the rank D.

Summary of Evaluation

In the image forming apparatus 100 in which the fixing device 102 in which the heat equalizing member 22 having the constitution (constitutional embodiment 1) shown in FIG. 5 of this embodiment is mounted is installed, both the evaluation results of the non-sheet-passing portion temperature rise and the FPOT are the ranks A, so that a good result was obtained. The constitution of the heat equalizing member 22 in the constitutional embodiment 1 satisfies Cα (thermal capacity in region α)>Cβ(thermal capacity in region β) and Cγ(thermal capacity in region γ)>Cβ(thermal capacity in region β). Further, in the heat equalizing member 22 of the constitutional embodiment 1, a constitution in which the region β provided with the opening is disposed on the longitudinal central side within the maximum size sheet width range of the recording material P capable of being passed through the fixing device 102 and in which the thermal conductivity of the heat equalizing member 22 in the region β is larger than the thermal conductivity of the heater is employed. By this, the heat equalizing member 22 of the constitutional embodiment 1 is capable of compatibly realizing the suppression of the non-sheet-passing portion temperature rise and the shortening of the FPOT. Incidentally, also in the image forming apparatus 100 in which the fixing device 102 in which the heat equalizing member 22 of the constitutional embodiment 2 provided with the isosceles triangular opening 27 in the region β is mounted is installed, similarly as in the constitutional embodiment 1, the evaluation results of the non-sheet-passing portion temperature rise and the FPOT were the ranks A.

As described above, according to this embodiment, it is possible to not only suppress the non-sheet-passing portion temperature rise in the fixing device but also shorten the FPOT.

OTHER EMBODIMENTS

As shown in FIG. 5, in the constitutional embodiment 1 of this embodiment, by providing the opening 26 in the region β of the heat equalizing member 22, Cα (thermal capacity in region α)>Cβ(thermal capacity in region β) and Cγ (thermal capacity in region γ)>Cβ(thermal capacity in region β) are satisfied. For example, the above-described magnitude relationship between the thermal capacities may also be satisfied by proving cut-away portions without providing the openings. Part (a) of FIG. 10 is a schematic view showing the heat equalizing member 22 having a constitution in which the cut-away portions are provided in the regions β on opposite end portion sides with respect to the widthwise direction, and part (b) of FIG. 10 is enlarged schematic view of the neighborhood of the right-hand end portion of the heat equalizing member shown in part (a) of FIG. 22 with respect to the longitudinal direction. The constitution of the heat equalizing member 22 in the region β shown in FIG. 10 is opposite in relationship of the opening from the constitution of the heat equalizing member in the region β shown in FIG. 5. That is, in the region β of the heat equalizing member shown in FIG. 10, the region of the opening in the region β shown in FIG. 5 is the region of the heat equalizing member 22, and the region (connecting portion) of the heat equalizing member 22 connecting the region α and the region γ is the region of the cut-away portion. Further, the above-described magnitude relationship between the thermal capacities may also be satisfied by changing a thickness of the heat equalizing member in the region β with respect to a layer (plate) thickness direction to a thickness different from those in the regions α and γ, not by providing the opening or the cut-away portion. In either constitution, the thermal capacities per unit area satisfy the magnitude relationships of Cα>Cβ and Cγ>Cβ, and the present invention does not limit the shape of the heat equalizing member 22 to a specific shape.

Further, as shown in FIG. 7, in the constitutional embodiment 2 of this embodiment, in the region β of the heat equalizing member 22, the isosceles triangular opening 27 is provided so that the thermal capacity per unit length decreases. By this, the condition of Cα (thermal capacity in region α)>Cβ (thermal capacity in region β) and Cγ (thermal capacity in region γ)>Cβ(thermal capacity in region β) is satisfied. For example, as in the above-described constitutional embodiments, the heat equalizing member 22 is provided with the cut-away portion, not the opening, so that the thermal capacity per unit length decreases toward the longitudinal end portion and the above-described magnitude relationship between the thermal capacities may also be satisfied. Part (a) of FIG. 11 is a schematic view showing the heat equalizing member 22 having a constitution in which cut-away portions are provided in the regions β, and part (b) of FIG. 11 is an enlarged schematic view of the neighborhood of the longitudinal right-hand end portion of the heat equalizing member 22 shown in part (a) of FIG. 11. In the region β of the heat equalizing member 22 in the constitutional embodiment 2 shown in FIG. 7, the isosceles triangular openings were provided from the magnitude size sheet width end positions toward the longitudinal center. In FIG. 11, at each of opposite end portions of the region β with respect to the widthwise direction, a triangular cut-away portion is formed from a region α-side end of the region β toward a region γ-side end of the region β, and at a central portion of the region β with respect to the widthwise direction, a region (connecting portion) of the heat equalizing member 22 connecting the region α and the region γ is provided. Further, a constitution in which by changing the thickness of the heat equalizing member 22 with respect to the film thickness direction, the above-described magnitude relationship between the thermal capacities is satisfied and in which the thermal capacity per unit length decreases toward the longitudinal end portion may also be employed. In either constitution, the thermal capacities per unit area may only be required to satisfy the magnitude relationship of $C\alpha > C\beta$ and $C\gamma > C\beta$, and the thermal capacity per unit length may only be required to decrease toward the longitudinal end portion, so that the present invention does not limit the shape of the heat equalizing member 22 to a specific shape.

As described above, also in the above-described other embodiments, it is possible to not only suppress the non-sheet-passing portion temperature rise in the fixing device but also shorten the FPOT.

The above-described embodiments of the present invention can also be realized by a computer of a system or apparatus that reads out and executes computer executable instructions (e.g., one or more programs) recorded on a storage medium (which may also be referred to more fully as a "non-transitory computer-readable storage medium") to perform the functions of one or more of the above-described embodiments and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disk (DVD), or Blu-ray Disk (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-162244 filed on Sep. 28, 2020, which is hereby incorporated by reference herein in its entirety.

What is claimed is:

1. A fixing device for fixing a toner image on a recording material, comprising:

a heater including a heat generating element;

a first rotatable member configured to be heated by said heat generating element;

a second rotatable member configured to form a nip in cooperation with said first rotatable member; and a heat equalizing member provided adjacent to a surface of said heater opposite from a surface of said heater opposing said first rotatable member and configured to equalize a temperature of said heater, wherein in a case that a region including a center of said heat equalizing member with respect to a longitudinal direction is a first region, a region closer to an end of said heat equalizing member than the first region is with respect to the longitudinal direction is a second region, and a region closer to the end of said heat equalizing member than the second region is with respect to the longitudinal direction is a third region, when said heat equalizing member has thermal capacities per unit length in said first region, said second region, and said third region are $C\alpha$, $C\beta$ and $C\gamma$, respectively, $C\alpha$, $C\beta$ and $C\gamma$ satisfy the following relationship:

$$C\alpha > C\beta, \text{ and } C\gamma > C\beta,$$

wherein said second region includes a cut-away portion formed by cutting away said heat equalizing member, wherein said second region includes said cut-away portion formed by cutting away said second region between an end portion of said first region and an end portion of said third region so that a length with respect to a widthwise direction of said heat equalizing member increases toward said third region at each of end portions thereof with respect to the widthwise direction, and includes a connecting portion connected between the end portion of said first region and the end portion of said third region on an inside of said second region.

2. A fixing device according to claim 1, wherein said second region and said third region are adjacent to each other at a position where an end portion of the recording material with a maximum width which is a length with respect to the longitudinal direction passes through said first rotatable member.

3. A fixing device according to claim 1, wherein said thermal capacity $C\beta$ is constant.

4. A fixing device according to claim 1, wherein a length of said connecting portion decreases from the end portion of said first region toward the end portion of said third region.

5. A fixing device according to claim 1, wherein said thermal capacity $C\beta$ decreases from the end portion of said first region toward the end portion of said third region.

6. A fixing device according to claim 1, wherein said first rotatable member includes a film.

7. A fixing device according to claim 6, wherein said heater is provided in an inside space of said film, and wherein the nip is formed by said heater and said second rotatable member through said film, and in the nip, the toner image is fixed on the recording material by heating the toner image by said film.

8. An image forming apparatus comprising:

image forming means configured to form a toner image on a recording material; and a fixing device according to claim 1 configured to fix the toner image on the recording material.

9. A fixing device for fixing a toner image on a recording material, comprising:

a heater including a heat generating element;

a first rotatable member configured to be heated by said heat generating element;

a second rotatable member configured to form a nip in cooperation with said first rotatable member; and a heat equalizing member provided adjacent to a surface of said heater opposite from a surface of said heater opposing said first rotatable member and configured to equalize a temperature of said heater, wherein in a case that a region including a center of said heat equalizing member with respect to a longitudinal direction is a first region, a region closer to an end of said heat equalizing member than the first region is with respect to the longitudinal direction is a second region, and a region closer to the end of said heat equalizing member than the second region is with respect to the longitudinal direction is a third region, when said heat equalizing member has thermal capacities per unit length in said first region, said second region, and said third region are Cα, Cβ and Cγ, respectively, Cα, Cβ and Cγ satisfy the following relationship:

$$C\alpha > C\beta, \text{ and } C\gamma > C\beta,$$

wherein said second region includes an opening penetrating through said heat equalizing member, wherein said second region includes said opening penetrating through an inside of said second region between an end portion of said first region and an end portion of said third region so that a length with respect to a widthwise direction of said heat equalizing member increases toward said third region, and includes a connecting portion connected between the end portion of said first region and the end portion of said third region at each of end portions thereof with respect to the widthwise direction.

10. A fixing device according to claim 9, wherein said second region and said third region are adjacent to each other at a position where an end portion of the recording material with a maximum width which is a length with respect to the longitudinal direction passes through said first rotatable member.

11. A fixing device according to claim 9, wherein a length of said connecting portion decreases from the end portion of said first region toward the end portion of said third region.

12. A fixing device according to claim 9, wherein said thermal capacity Cβ decreases from the end portion of said first region toward the end portion of said third region.

13. A fixing device according to claim 9, wherein said first rotatable member includes a film.

14. A fixing device according to claim 13, wherein said heater is provided in an inside space of said film, and wherein the nip is formed by said heater and said second rotatable member through said film, and in the nip, the toner image is fixed on the recording material by heating the toner image by said film.

15. An image forming apparatus comprising:

image forming means configured to form a toner image on a recording material; and a fixing device according to claim 9 configured to fix the toner image on the recording material.

* * * * *